US007675496B2

(12) United States Patent
Chen et al.

(10) Patent No.: US 7,675,496 B2
(45) Date of Patent: Mar. 9, 2010

(54) LIQUID CRYSTAL DISPLAY AND DRIVING METHOD THEREOF

(75) Inventors: Eddy Giing-Lii Chen, Miao-Li (TW); Sz-Hsiao Chen, Miao-Li (TW); Tsau-Hua Hsieh, Miao-Li (TW)

(73) Assignee: Innolux Display Corp., Miao-Li County (TW)

( * ) Notice: Subject to any disclaimer, the term of this patent is extended or adjusted under 35 U.S.C. 154(b) by 694 days.

(21) Appl. No.: 11/644,916

(22) Filed: Dec. 21, 2006

(65) Prior Publication Data

US 2007/0139346 A1 Jun. 21, 2007

(30) Foreign Application Priority Data

Dec. 21, 2005 (CN) ..... 2005 1 0121013

(51) Int. Cl.
*G09G 3/36* (2006.01)

(52) U.S. Cl. ..... 345/87; 345/89

(58) Field of Classification Search ..... 345/87–100, 345/204

See application file for complete search history.

(56) References Cited

U.S. PATENT DOCUMENTS 6,693,618 B2 * 2/2004 Son et al. ..... 345/99
6,771,243 B2 8/2004 Shigeki
7,133,015 B1 * 11/2006 Yoshida et al. ..... 345/99
7,429,981 B2 * 9/2008 Shimoshikiryoh ..... 345/204
2003/0058229 A1 * 3/2003 Kawabe et al. ..... 345/204
2004/0196229 A1 * 10/2004 Ham ..... 345/87
2005/0280612 A1 * 12/2005 Yamamoto et al. ..... 345/75.2
2006/0139289 A1 * 6/2006 Yoshida et al. ..... 345/98
2006/0176261 A1 * 8/2006 Nitta et al. ..... 345/94
2009/0046048 A1 * 2/2009 Shimoshikiryoh ..... 345/99

* cited by examiner

*Primary Examiner*—Nitin Patel
(74) *Attorney, Agent, or Firm*—Wei Te Chung

(57) ABSTRACT

An exemplary liquid crystal display (600) includes a liquid crystal panel, a scanning driving circuit (61), a compensation circuit (68), a control circuit (67), and a signal line driving circuit (62). The liquid crystal panel includes a first substrate, a second substrate opposite to the first substrate, and a liquid crystal layer sandwiched between the first and second substrates. The first substrate includes a plurality of scanning lines (63) that are parallel to each other and that each extend along a first direction, and a plurality of signal lines (64) that are parallel to each other and that each extend along a second direction orthogonal to the first direction. The scanning driving circuit is connected to the scanning lines, and continuously scans the same scanning lines twice in a frame time. The compensation circuit generates first signals. The control circuit generates gradation signals corresponding to the second frame image data.

16 Claims, 6 Drawing Sheets

LIQUID CRYSTAL DISPLAY AND DRIVING METHOD THEREOF

FIELD OF THE INVENTION

The present invention relates to liquid crystal displays (LCDs), and particularly to an active matrix LCD which is. suitable for motion picture display and a driving method for driving the LCD.

BACKGROUND

Because LCD devices have the advantages of portability, low power consumption, and low radiation, they have been widely used in various portable information products such as notebooks, personal digital assistants (PDAs), video cameras, and the like. Furthermore, LCD devices are considered by many to have the potential to completely replace cathode ray tube (CRT) monitors and televisions.

FIG. 5 is an abbreviated circuit diagram of a typical LCD. The LCD 100 includes a first glass substrate (not shown), a second glass substrate (not shown) facing the first substrate, a liquid crystal layer (not shown) sandwiched between the first and second substrates, a scanning line driving circuit 11, a signal line driving circuit 12, and a timing control circuit 17.

The first substrate includes a number n (where n is a natural number) of scanning lines 13 that are parallel to each other and that each extend along a first direction, and a number k (where k is also a natural number) of signal lines 14 that are parallel to each other and that each extend along a second direction orthogonal to the first direction. The first substrate also includes a plurality of thin film transistors (TFTs) 15 that function as switching elements. The first substrate further includes a plurality of pixel electrodes 151 formed on a surface thereof facing the second substrate. Each TFT 15 is provided in the vicinity of a respective point of intersection of the scanning lines 13 and the signal lines 14.

Each TFT 15 includes a gate electrode, a source electrode, and a drain electrode. The gate electrode of the TFT 15 is connected to the corresponding scanning line 13. The source electrode of the TFT 15 is connected to the corresponding signal line 14. The drain electrode of the TFT 15 is connected to a corresponding pixel electrode 151.

The second substrate includes a plurality of common electrodes 152 opposite to the pixel electrodes 151. In particular, the common electrodes 152 are formed on a surface of the second substrate that faces the first substrate, and are made from a transparent material such as Indium-Tin Oxide (ITO) or the like. A pixel electrode 151, a common electrode 152 facing the pixel electrode 151, and liquid crystal molecules of the liquid crystal layer sandwiched between the two electrodes 151, 152 cooperatively define a single pixel unit.

The scanning lines 13 are connected to the scanning line driving circuit 11. The signal lines 14 are connected to the signal line driving circuit 12.

FIG. 6 is an abbreviated timing chart illustrating operation of the LCD 100. A scanning clock signal (CLK) is generated by the timing control circuit 17. Scanning signals G1-Gn are generated by the scanning line driving circuit 11, and are applied to the scanning lines 13. Gradation voltages (VD) are generated by the signal line driving circuit 12, and are sequentially applied to the signal lines 14. A common voltage (Vcom) is applied to all the common electrodes 152. Only one scanning signal pulse 19 is applied to each scanning line 13 during each single scan, the scanning signal pulse 19 having a duration which is equal to a period of the clock pulses of the scanning clock signal CLK. The scanning signal pulses 19 are output sequentially to the scanning lines 13.

The scanning line driving circuit 11 sequentially provides scanning pulses 19 (G1 to Gn) to the scanning lines 13, and activates the TFTs 15 respectively connected to the scanning lines 13. When the scanning lines 13 are thus scanned, the signal line driving circuit 12 outputs gradation voltages VD corresponding to the image data to the signal lines 14. Then the gradation voltages are applied to the pixel electrodes 151 via the activated TFTs 15. The potentials of all the common electrodes 152 are set at a uniform potential. The gradation voltages VD written to the pixel electrodes 151 are used to control the amount of light transmission at the corresponding pixel units. Consequently, the pixel units cooperatively provide an image for display on a screen of an LC panel 10 of the LCD 100.

The gradation voltage VD is a signal whose strength varies in accordance with each piece of image data, whereas the common voltage Vcom is a signal that has a constant value which does not vary at all.

If the LCD 100 provides motion picture display, problems of poor image quality may occur for a variety of reasons. For example, the residual image phenomenon may occur because a response speed of the liquid crystal molecules is too slow. In particular, when a gradation voltage variation occurs, the liquid crystal molecules are unable to track the gradation voltage variation within a single frame period, and instead produce a cumulative response during several frame periods. Consequently, considerable research is being conducted with a view to developing various high-speed response liquid crystal materials that can overcome this problem.

Further, the aforementioned problems such as the residual image phenomenon are not caused solely by the response speed of the liquid crystal molecules. For example, when the displayed image is changed in each frame period (the period that the scanning line driving circuit 11 completes sequential scanning from G1 to Gn once) to display the motion picture, the displayed image of one frame period may remain in a viewer's visual perception as an afterimage, and this afterimage overlaps with the viewer's perception of the displayed image of the next frame period. This means that from the viewpoint of a user, the image quality of the displayed image is impaired.

What is needed, therefore, is an LCD that can overcome the above-described deficiencies.

SUMMARY

In one embodiment, a liquid crystal display includes a liquid crystal panel, a scanning driving circuit, compensation circuit, a control circuit, and a signal line driving circuit. The liquid crystal panel includes a first substrate, a second substrate opposite to the first substrate, and a liquid crystal layer sandwiched between the first and second substrates. The first substrate includes a plurality of scanning lines that are parallel to each other and that each extend along a first direction, and a plurality of signal lines that are parallel to each other and that each extend along a second direction orthogonal to the first direction. The scanning driving circuit is connected to the scanning lines, and continuously scans the same scanning lines twice in a frame time. The compensation circuit generates first signals, which first signals represent compensation gradation corresponding to a first frame image data and a second frame image data next to the first frame image data. The control circuit generates gradation signals corresponding to the second frame image data. The signal line driving circuit receives the first signals when the scanning lines are scanned a first time in the frame time and generates compensation voltages and provides the compensation voltages to the signal lines, and receives the gradation signals when the scanning time are scanned a second time in the frame time and generates gradation voltages and provides gradation voltages corresponding to the gradation signals to the signal lines.

Other advantages and novel features will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of at least one embodiment of the present invention. In the drawings, like reference numerals designate corresponding parts throughout various views, and all the views are schematic.

DETAILED DESCRIPTION OF PREFERRED EMBODIMENTS

Reference will now be made to the drawings to describe various embodiments of the present invention in detail.

Figure 1:
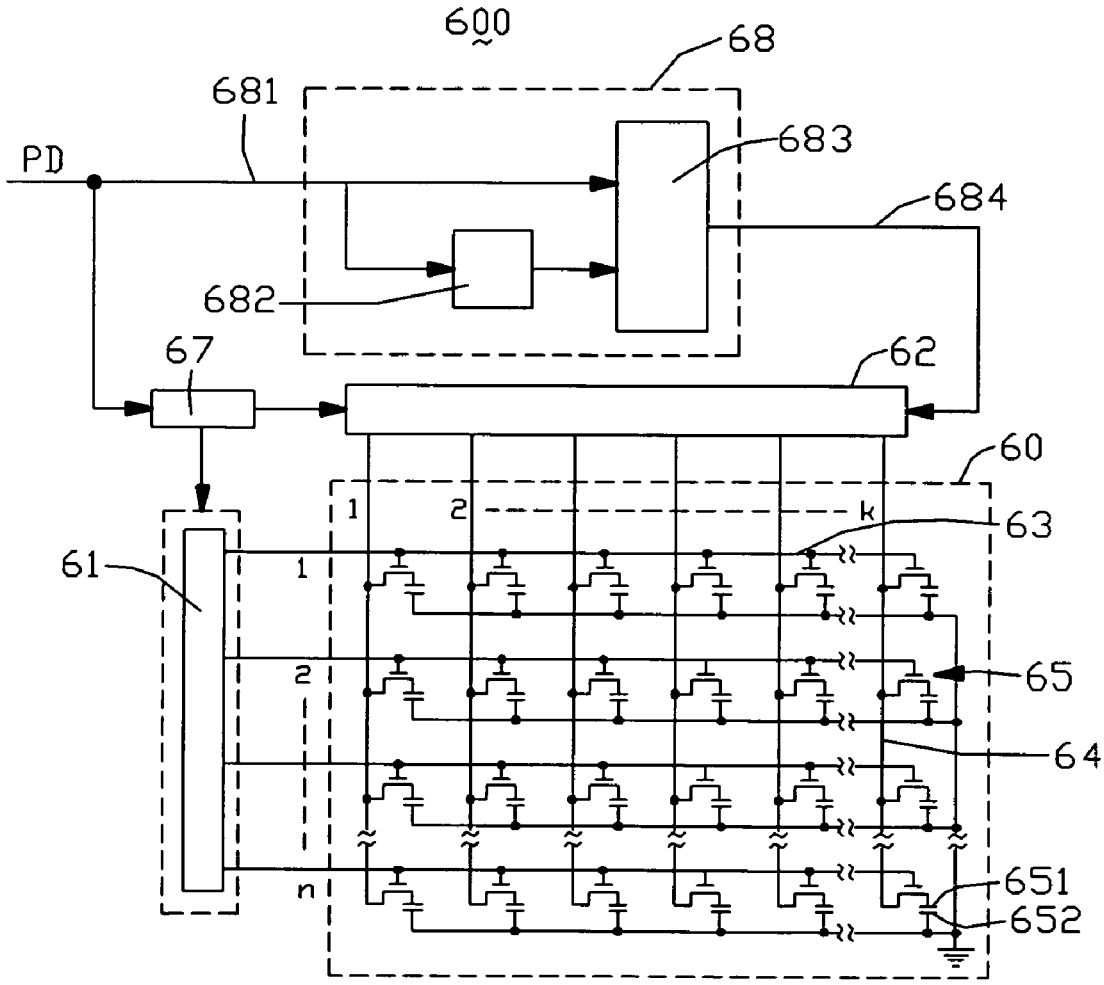
FIG. 1 is an abbreviated circuit diagram of an LCD according to a first embodiment of the present invention.

FIG. 1, an LCD 600 according to a first embodiment of the present invention includes a liquid crystal panel 60, a scanning line driving circuit 61, a signal line driving circuit 62, a control circuit 67, and a compensation circuit 68. The liquid crystal panel 60 includes a first glass substrate (not shown), a second glass substrate (not shown) facing the first substrate, and a liquid crystal layer (not shown) sandwiched between the first and second substrates. In the illustrated embodiment, the liquid crystal panel 60 is a twisted-nematic type liquid crystal panel.

The first substrate includes a number n (where n is a natural number) of scanning lines 63 that are parallel to each other and that each extend along a first direction, and a number k (where k is also a natural number) of signal lines 64 that are parallel to each other and that each extend along a second direction orthogonal to the first direction. The first substrate also includes a plurality of TFTs 65 that function as switching elements. The first substrate further includes a plurality of pixel electrodes 651 formed on a surface thereof facing the second substrate. Each TFT 65 is provided in the vicinity of a respective point of intersection of the scanning lines 63 and the signal lines 64.

Each TFT 65 includes a gate electrode, a source electrode, and a drain electrode. The gate electrode of the TFT 65 is connected to the corresponding scanning line 63. The source electrode of the TFT 65 is connected to the corresponding signal line 64. The drain electrode of the TFT 65 is connected to a corresponding pixel electrode 651.

The second substrate includes a plurality of common electrodes 652 opposite to the pixel electrodes 651. In particular, the common electrodes 652 are formed on a surface of the second substrate that faces the first substrate, and are made from a transparent material such as ITO or the like. One pixel electrode 651, one common electrode 652 facing the pixel electrode 651, and liquid crystal molecules of the liquid crystal layer sandwiched between the two electrodes 651, 652 cooperatively define a single pixel unit.

The scanning lines 63 are connected to the scanning line driving circuit 61. The signal lines 64 are connected to the signal line driving circuit 62.

The compensation circuit 68 includes a signal receiving terminal 681, a retardation circuit 682, and a register 683. The register 683 includes two input terminals and an output terminal 684. The signal receiving terminal 681 is directly connected to one of the input terminals of the register 683, and is connected to the other input terminal of the register 683 via the retardation circuit 682. The output terminal 684 is connected to the signal line driving circuit 62. The register 683 includes a query chart. The query chart generates signals which represent compensation gradation. The signals are the result of a comparison of a first frame image data to a second frame image data next to the first frame image data.

An exemplary method for driving the LCD 600 includes the following. Each frame is divided into a first period T1 and a second period T2. During the first period T1, scanning signals are generated by the scanning line driving circuit 61, and are applied to the scanning lines 63. At the same time, compensation voltages (CVD) are generated by the signal line driving circuit 62, and are sequentially applied to the signal lines 64. During the second period T2, scanning signals are generated by the scanning line driving circuit 61, and are applied to the scanning lines 63. At the same time, gradation voltages (VD) are generated by the signal line driving circuit 62, and are sequentially applied to the signal lines 64. In the first embodiment, the first period T1 is equal to the second period T2. In alternative embodiments, the first period T1 can be greater than the second period T2, or the first period T1 can be less than the second period T2.

Figure 2:
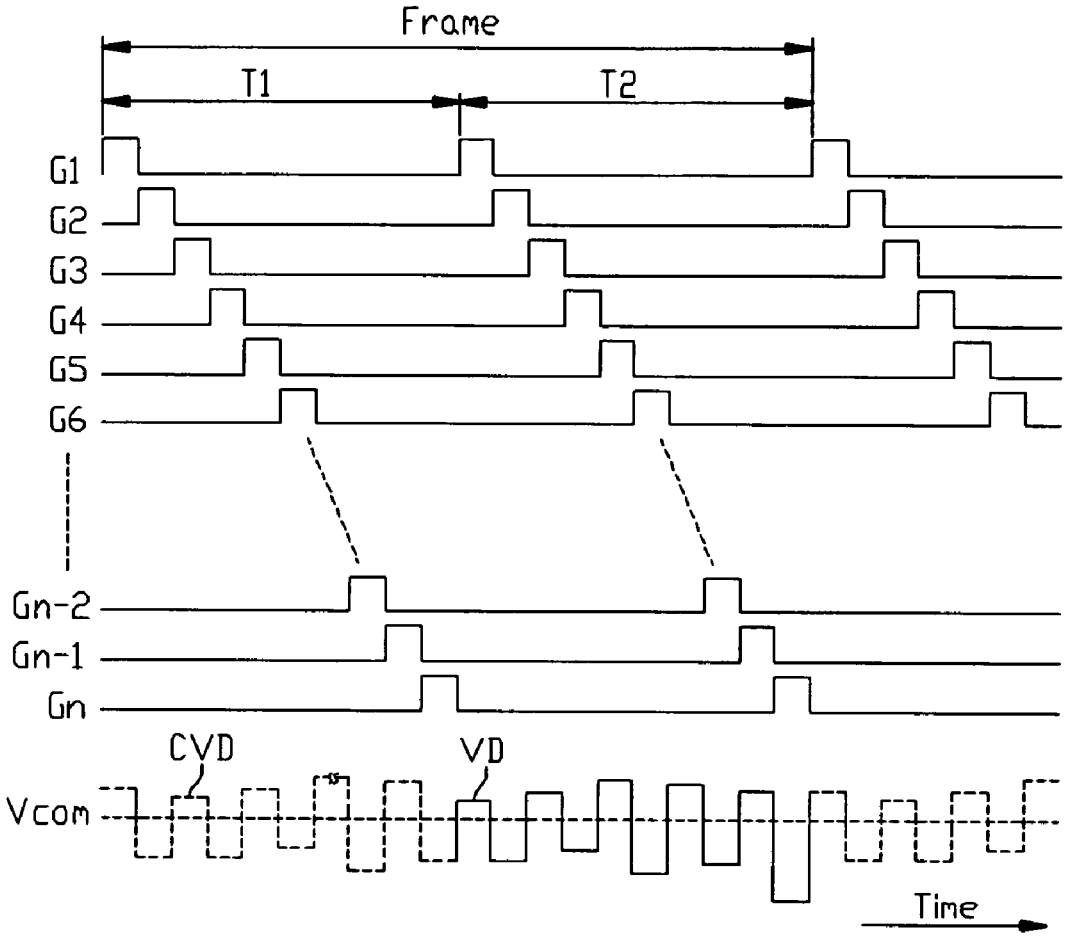
FIG. 2 is an abbreviated timing chart illustrating operation of the LCD of FIG. 1.

FIG. 2 is an abbreviated timing chart illustrating operation of the LCD 600. Scanning signals G1-Gn are generated by the scanning line driving circuit 61, and are applied to the scanning lines 63. The gradation voltages (VD) are generated by the signal line driving circuit 62, and are sequentially applied to the signal lines 64. A common voltage (Vcom) is applied to all the common electrodes 652. Scanning signal pulses are output sequentially to the scanning lines 63. Only two scanning signal pulses in total are applied to each scanning line 63 during each single scan.

A first frame image data is transmitted to the compensation circuit 68 via the signal receiving terminal 681, and is stored in the retardation circuit 682. A second frame image data next to the first frame image data is transmitted to the compensation circuit 68 via the signal receiving terminal 681, and is stored in the register 683. The first frame image data and the second frame image data are provided by an external circuit (not shown). The register 683 also receives the first frame image data, which is transmitted from the retardation circuit 682. The register 683 compares the first frame image data to the second frame image data, and transmits signals which represent compensation gradation (CVD) to the signal line driving circuit 62 via the output terminal 684.

During the first period T1, the scanning line driving circuit 61 sequentially provides scanning pulses (G1 to Gn) to the scanning lines 63, and activates the TFTs 65 respectively connected to the scanning lines 63. When the scanning lines 63 are thus scanned, the signal line driving circuit 62 outputs compensation voltages to the signal lines 64, which compensation voltages are determined by the signals provided by the register 683. Then the compensation voltages are applied to the pixel electrodes 651 via the activated TFTs 65. This enables the pixel units to each provide a desired amount of light transmission.

During the second period T2, the scanning line driving circuit 61 sequentially provides scanning pulses (G1 to Gn) to the scanning lines 63, and activates the TFTs 65 respectively connected to the scanning lines 63. When the scanning lines 63 are thus scanned, the control circuit 67 outputs gradation signals to the signal line driving circuit 62, which gradation signals are determined by the second frame image data next to the first frame image data. Then the signal line driving circuit 62 outputs gradation voltages to the signal lines 64, the gradation voltages corresponding to the gradation signals. The gradation voltages are applied to the pixel electrodes 651 via the activated TFTs 65, thus enabling each of the pixel units to keep providing the desired amount of light transmission.

In summary, the signal line driving circuit 62 provides compensation voltages to the pixel electrodes 651 during the first period T1, which compensation voltages are determined by the corresponding signals provided by the register 683 after the register 683 compares the second frame image data to the first frame image data, and provides normal gradation voltages to the pixel electrodes 651 during the second period T2. Accordingly, a response speed of the liquid crystal molecules is sufficiently accelerated, the desired amount of light transmission is provided during the first period T1, and the desired amount of light transmission is maintained during the second period T2. Therefore the LCD 600 has a fast response speed and desired gradation, and can provide an optimized display quality.

In an alternative embodiment, the liquid crystal panel 60 can be replaced with an in-plane-switching (IPS) panel. Common electrodes and pixel electrodes are formed at a same one of two substrates of the IPS panel.

Figure 3:
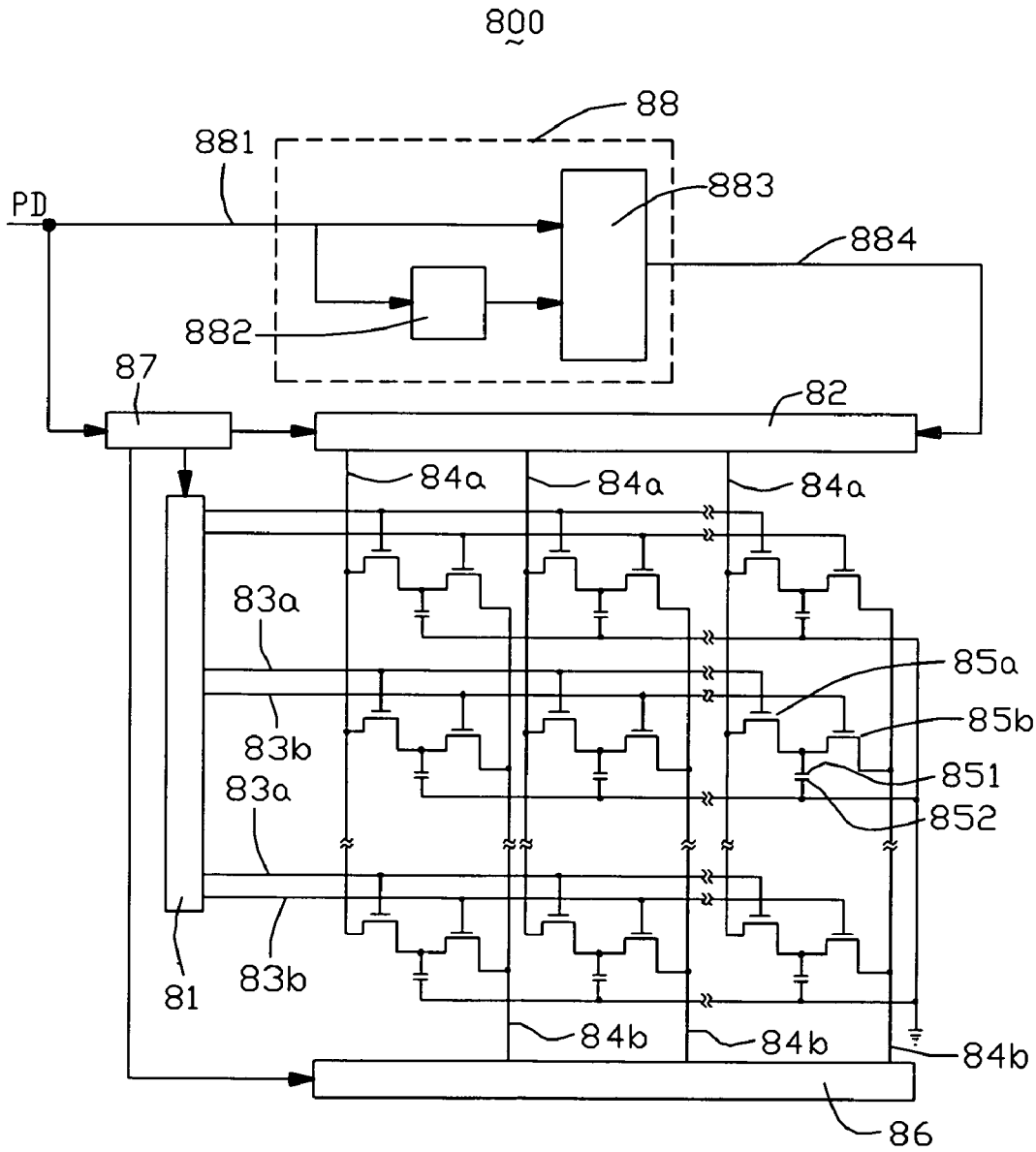
FIG. 3 is an abbreviated circuit diagram of an LCD according to a second embodiment of the present invention.

In FIG. 3, an LCD 800 according to a second embodiment of the present invention includes a liquid crystal panel (not labeled), a scanning line driving circuit 81, a first signal line driving circuit 82, a second signal line driving circuit 86, a control circuit 87, and a compensation circuit 88. The liquid crystal panel includes a first glass substrate (not shown), a second glass substrate (not shown) facing the first substrate, and a liquid crystal layer (not shown) sandwiched between the first and second substrates. In the illustrated embodiment, the liquid crystal panel is a twisted-nematic type liquid crystal panel.

The first substrate includes a number of first scanning lines 83*a*, a number of second scanning lines 83*b*, a number of first signal lines 84*a*, and a number of second signal lines 84*b*. The first scanning lines 83*a* are parallel to the second scanning lines 83*b*. The first scanning lines 83*a* and. the second scanning lines 83*b* extend along a first direction, and are alternately arranged one parallel to the other. The first signal lines 84*a* are parallel to the second signal lines 84*b*. The first signal lines 84*a* and the second signal lines 84*b* extend along a second direction orthogonal to the first direction, and are alternately arranged one parallel to the other. The first substrate also includes a plurality of first TFTs 85*a* and a plurality of second TFTs 85*b* that function as switching elements. The first and second TFTs 85*a*, 85*b* are arranged in pairs, with each pair having one first TFT 85*a* and one second TFT 85*b*. The first substrate further includes a plurality of pixel electrodes 851 formed on a surface thereof facing the second substrate. Each first TFT 85*a* is provided in the vicinity of a respective point of intersection of the first scanning lines 83*a* and the first signal lines 84*a*. Each corresponding second TFT 85*b* is provided distal from the respective point of intersection of the first scanning lines 83*a* and the first signal lines 84*a*.

Each first TFT 85*a* includes a first gate electrode, a first source electrode, and a first drain electrode. The first gate electrode of the first TFT 85*a* is connected to the corresponding first scanning line 83*a*. The first source electrode of the first TFT 85*a* is connected to the corresponding first signal line 84*a*. The first drain electrode of the first TFT 85*a* is connected to a corresponding pixel electrode 851.

Each second TFT 85*b* includes a second gate electrode, a second source electrode, and a second drain electrode. The second gate electrode of the second TFT 85*b* is connected to the corresponding second scanning line 83*b*. The second source electrode of the second TFT 85*b* is connected to the corresponding second signal line 84*b*. The second drain electrode of the second TFT 85*b* is connected to a corresponding pixel electrode 851. In each pair of first and second TFTs 85*a*, 85*b*, the first and second TFTs 85*a*, 85*b* are connected to the one same corresponding pixel electrode 851.

The second substrate includes a plurality of common electrodes 852 opposite to the pixel electrodes 851. In particular, the common electrodes 852 are formed on a surface of the second substrate that faces the first substrate, and are made from a transparent material such as ITO or the like. A pixel electrode 851, a common electrode 852 facing the pixel electrode 851, and liquid crystal molecules of the liquid crystal layer sandwiched between the two electrodes 851, 852 cooperatively define a single pixel unit. Each pixel unit is cooperatively driven by a corresponding pair of first and second TFTs 85*a*, 85*b*.

The first and second scanning lines 83*a*, 83*b* are connected to the scanning line driving circuit 81. The first and second signal lines 84*a*, 84*b* are connected to the first and second signal line driving circuits 82, 86, respectively.

The compensation circuit 88 includes a signal receiving terminal 881, a retardation circuit 882, and a register 883. The register 883 includes two input terminals and an output terminal 884. The signal receiving terminal 881 is directly connected to one of the input terminals of the register 883, and is also connected to the other input terminal of the register 883 via the retardation circuit 882. The output terminal 884 is connected to the first signal line driving circuit 82. The register 883 includes a query chart. The query chart generates signals which represent compensation gradation. The signals are the result of a comparison of a first frame image data to a second frame image data next to the first frame image data.

An exemplary method for driving the LCD 800 includes the following. During a first frame time, scanning signals are generated by the scanning line driving circuit 81, and are applied to the first scanning lines 83*a*. When the first scanning lines 83*a* are thus scanned, compensation voltages are generated by the first signal line driving circuit 82, and are sequentially applied to the first signal lines 84*a*. During the first frame time and the second frame time next to the first frame time, scanning signals are generated by the scanning line driving circuit 81, and are applied to the second scanning lines 83*b*. When the second signal lines 83*b* are thus scanned, gradation voltages are generated by the second signal line driving circuit 86, and are sequentially applied to the second signal lines 84*b*. A time difference exists between the first frame time and the second frame time. In the illustrated embodiment, the time difference is half a frame time or two-thirds of a frame time.

Figure 4:
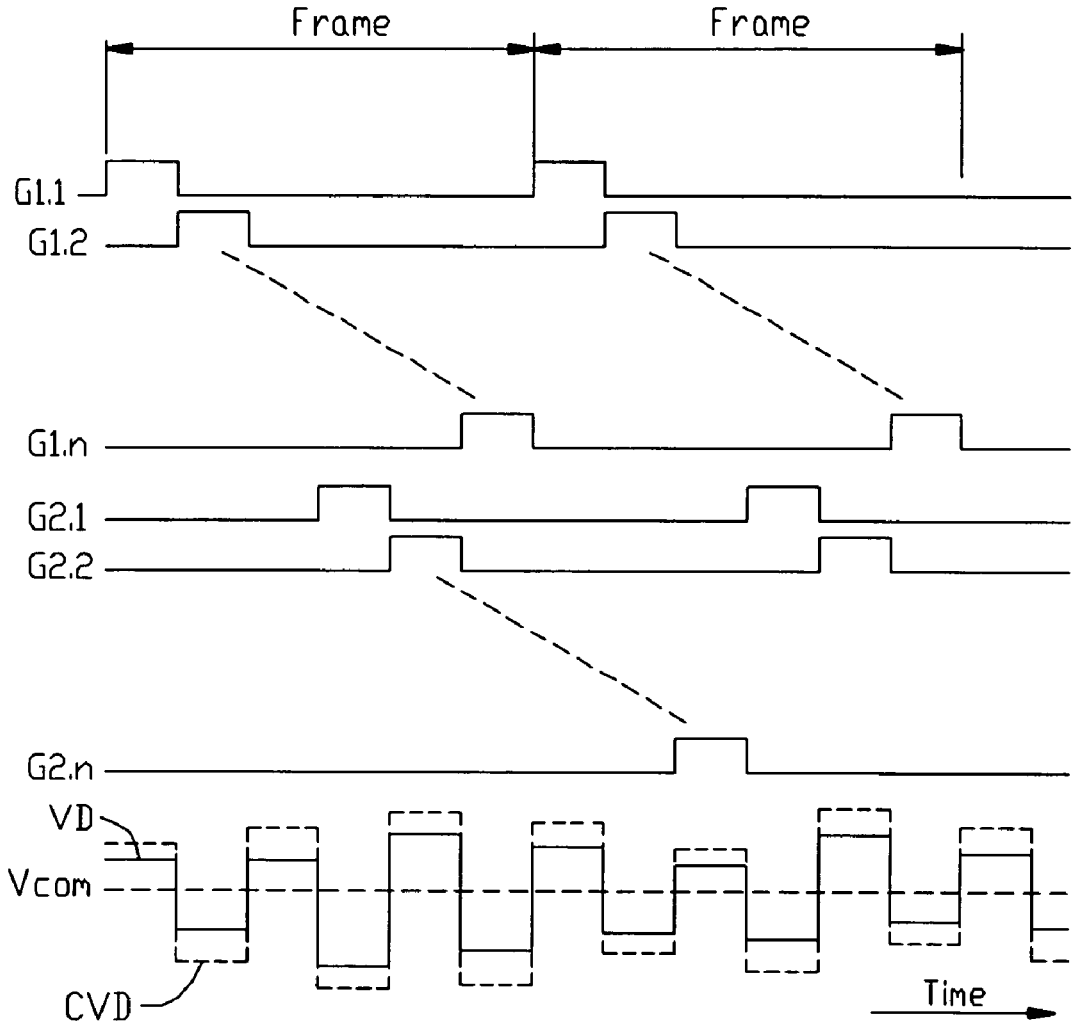
FIG. 4 is an abbreviated timing chart illustrating operation of the LCD of FIG. 3.
Figure 5:
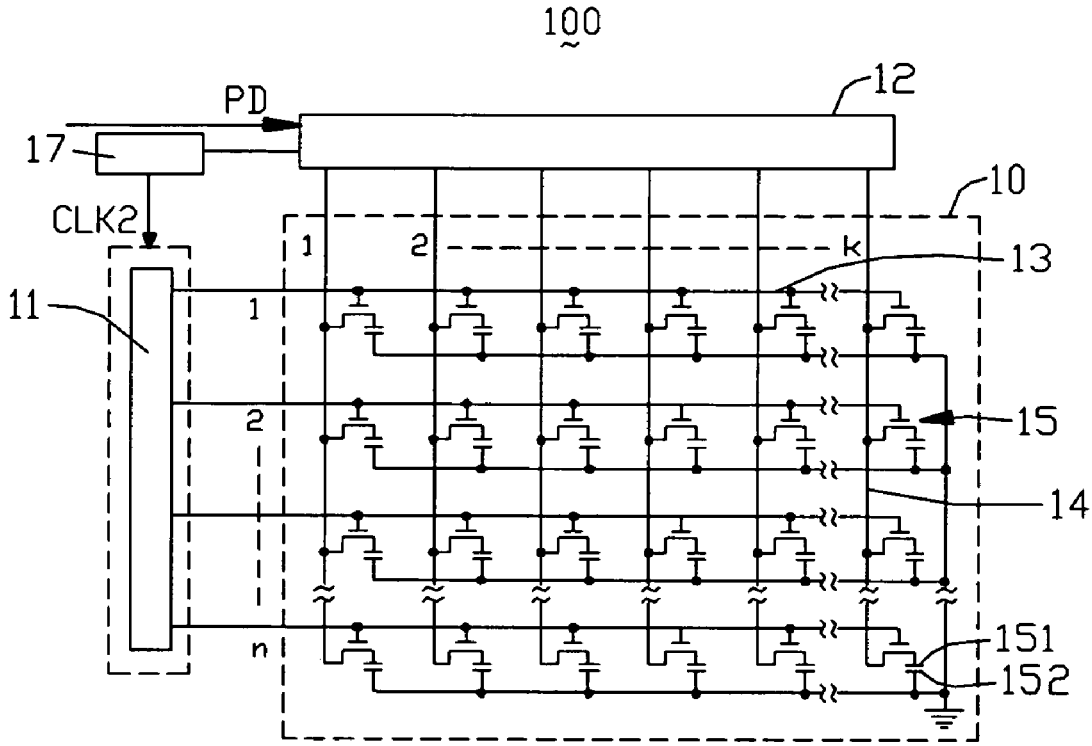
FIG. 5 (RELATED ART)
FIG. 5 is an abbreviated circuit diagram of a conventional LCD.
Figure 6:
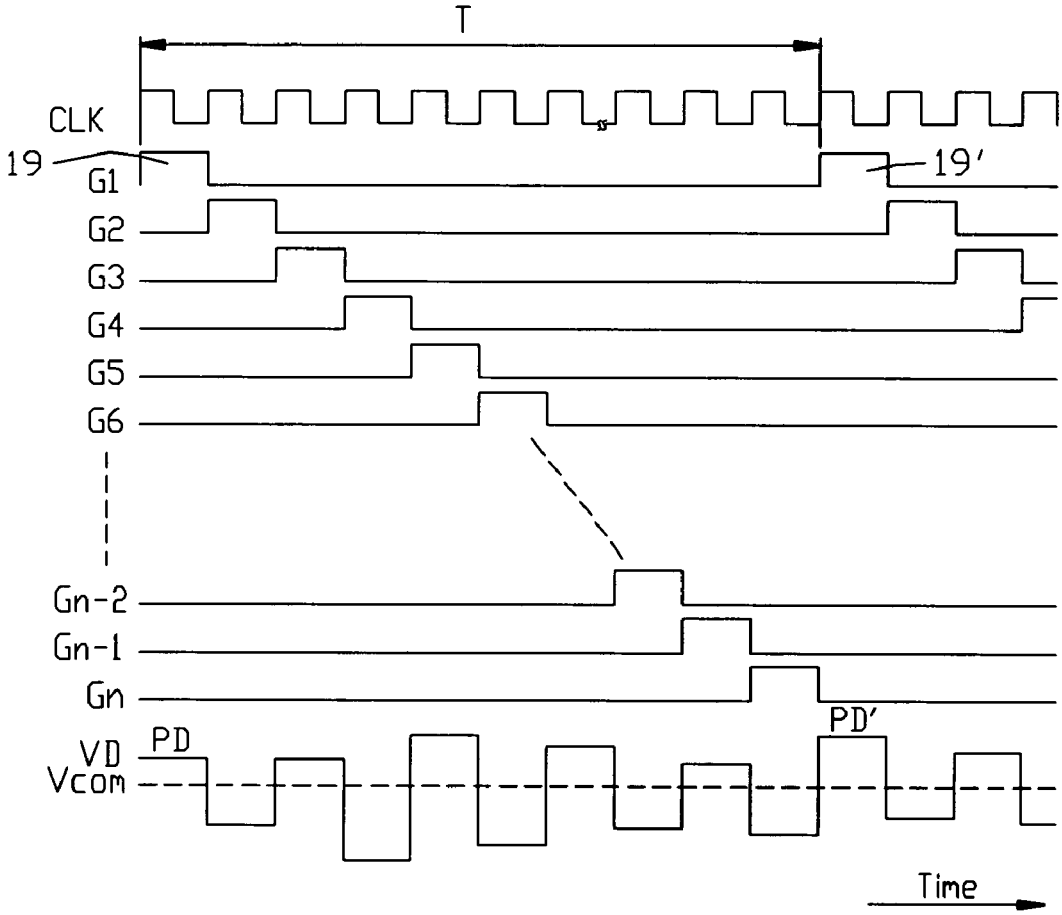
FIG. 6 (RELATED ART)
FIG. 6 is an abbreviated timing chart illustrating operation of the LCD of FIG. 5.

FIG. 4 is an abbreviated timing chart illustrating operation of the LCD 800. A first frame image data is transmitted to the compensation circuit 88 via the signal receiving terminal 881, and is stored in the retardation circuit 882. A second frame image data next to the first frame image data is transmitted to the compensation circuit 88 via the signal receiving terminal 881, and is stored in the register 883. The first frame image data and the second frame image data are provided by an external circuit (not shown). The register 883 also receives the first frame image data, which is transmitted from the retardation circuit 882. The register 883 compares the first frame image data to the second frame image data, and transmits corresponding signals to the first signal line driving circuit 82 via the output terminal 884 of the register 884, which signals are determined by the second frame image data and the first frame image data.

During the first frame time, the scanning line driving circuit 81 sequentially provides scanning pulses G1.x to the first scanning lines 83*a*, and activates the first TFTs 85*a* respectively connected to the first scanning lines 83*a*. When the first scanning lines 83*a* are thus scanned, the first signal line driving circuit 82 outputs compensation voltages to the first signal lines 84*a*, which compensation voltages are determined by the signals provided by the register 883. Then the compensation voltages are applied to the pixel electrodes 851 via the activated first TFTs 85*a*. This enables the pixel units to provide a desired amount of light transmission.

During the first frame time and the second frame time, the scanning line driving circuit 81 sequentially provides scanning pulses G2.x to the second scanning lines 83*b*, and activates the second TFTs 85*b* respectively connected to the second scanning lines 83*b*. When the second scanning lines 83b are thus scanned, the control circuit 87 outputs gradation signals to the second signal line driving circuit 86, which gradation signals are determined by the second frame image data next to the first frame image data. Then the second signal line driving circuit 86 outputs gradation voltages to the second signal lines 84*b*, the gradation voltages corresponding to the gradation signals. The gradation voltages are applied to the pixel electrodes 851 via the activated second TFTs 85*b*. This enables the pixel units to keep providing the desired amount of light transmission. When the first scanning lines 83a are scanned, a time difference exists before the second scanning lines 83*b* are scanned. In the illustrated embodiment, the scanning pulses G2.x lag relative to the scanning pulses G1.x by half a frame time or a two-thirds of a frame time.

In summary, the first signal line driving circuit 82 provides compensation voltages to the pixel electrodes 851 during the first frame time via the first TFTs 85*a*, which compensation voltages are determined by the corresponding signals provided by the register 883 after the register 883 compares the second frame image data to the first frame image data. The second signal line driving circuit 86 provides normal gradation voltages to the pixel electrodes 851 during the second frame time with a half-frame time lag via the second TFTs 85*b*. Accordingly, a response speed of the liquid crystal molecules is sufficiently accelerated, the desired amount of light transmission is provided during the frame time, and the desired amount of light transmission is maintained during the adjacent frame time. Therefore the LCD 800 has a fast response speed and desired gradation, and can provide an optimized display quality.

In an alternative embodiment, the liquid crystal panel can be replaced with an IPS panel. Common electrodes and pixel electrodes are formed at a same one of two substrates of the IPS panel.

It is believed that the present embodiments and their advantages will be understood from the foregoing description, and it will be apparent that various changes may be made thereto without departing from the spirit or scope of the invention or sacrificing all of its material advantages, the examples hereinbefore described merely being preferred or exemplary embodiments of the invention.

What is claimed is:

1. A liquid crystal display comprising:

a liquid crystal panel comprising:

a first substrate comprising:

a plurality of scanning lines that are parallel to each other and that each extend along a first direction; and a plurality of signal lines that are parallel to each other and that each extend along a second direction orthogonal to the first direction; and a second substrate opposite to the first substrate; and a liquid crystal layer sandwiched between the first and second substrates; and a scanning driving circuit connected to the scanning lines, the scanning driving circuit continuously scanning the same scanning lines twice in a frame time;

a compensation circuit generating first signals, which first signals represent compensation gradation corresponding to a first frame image data and a second frame image data next to the first frame image data;

a control circuit generating gradation signals corresponding to the second frame image data; and a signal line driving circuit, the signal line driving circuit receiving the first signals when the scanning lines are scanned a first time in the frame time and generating corresponding compensation voltages and providing the compensation voltages to the signal lines, and receiving the gradation signals when the scanning lines are scanned a second time in the frame time and generating gradation voltages corresponding to the gradation signals and providing the gradation voltages to the signal lines.

2. The liquid crystal display as claimed in claim 1, wherein the liquid crystal panel is a twisted-nematic type liquid crystal panel or an in-plane-switching (IPS) liquid crystal panel.

3. The liquid crystal display as claimed in claim 2, wherein the first substrate further comprises a plurality of pixel electrodes, and the second substrate comprises a plurality of common electrodes opposite to the pixel electrodes.

4. The liquid crystal display as claimed in claim 3, wherein the first substrate further comprises a plurality of thin film transistors provided in vicinity of a respective point of intersection of the scanning lines and the signal lines, and each thin film transistor includes a gate electrode connected to the corresponding scanning line, a source electrode connected to the corresponding signal line, and a drain electrode connected to a corresponding pixel electrode.

5. The liquid crystal display as claimed in claim 1, wherein the compensation circuit comprises a signal receiving terminal, a retardation circuit, and a register; the register comprising two input terminals and an output terminal; the signal receiving terminal being directly connected to one of the input terminals of the register, and being also connected to the other input terminal of the register via the retardation circuit; the output terminal being connected to the signal line driving circuit; the register comprising a query chart, which query chart generates signals which represent compensation gradation and the signals being the result of a comparison of the first frame image data to the second frame image data next to the first frame image data.

6. A method of driving the liquid crystal display in claim 1, the method comprising:

dividing a frame time into a first period and a second period;

scanning the scanning lines by the scanning driving circuit in the first period and generating compensation voltages and providing the compensation voltages to the signal lines at the same time; and scanning the scanning lines by the scanning driving circuit in the second period and generating gradation voltages and providing the gradation voltages to the signals lines at the same time.

7. The driving method as claimed in claim 6, wherein the first period is equal to the second period.

8. The driving method as claimed in claim 6, wherein the first period is greater than the second period.

9. The driving method as claimed in claim 6, wherein the first period is less than the second period.

10. The driving method as claimed in claim 6, wherein the compensation voltages are determined by the first signals of the first frame image data and the second frame image data.

11. The driving method as claimed in claim 10, wherein the gradation voltages are determined by the second frame image data.

12. A liquid crystal display comprising:

a liquid crystal panel comprising:

a first substrate comprising:

a plurality of first scanning lines that are parallel to each other and that each extend along a first direction;

a plurality of second scanning lines parallel to and alternately arranged with the first scanning lines;

a plurality of first signal lines that are parallel to each other and that each extend along a second direction orthogonal to the first direction; and a plurality of second signal lines parallel to and alternately arranged with the first signal lines;

a second substrate opposite to the first substrate; and a liquid crystal layer sandwiched between the first and second substrates; and a scanning driving circuit connected to the first and second scanning lines, the scanning driving circuit scanning the first and second scanning lines;

a compensation circuit generating first signals, which first signals represent compensation gradation corresponding to a first frame image data and a second frame image data next to the first frame image data, the first frame image data and the second frame image data being provided by an external circuit;

a control circuit generating gradation signals corresponding to the second frame image data;

a first signal line driving circuit connected to the first signal lines, the first signal line driving circuit receiving the first signals and generating compensation voltages and providing the compensation voltages to the first signal lines when the first scanning lines are scanned, wherein the compensation voltages are determined by the first signals; and a second signal line driving circuit connected to the second signal lines, the second signal line driving circuit receiving the gradation signals and generating gradation voltages and providing the gradation voltages to the second signal lines when the second scanning lines are scanned, wherein the gradation voltages are determined by the gradation signals.

13. The liquid crystal display as claimed in claim 12, wherein the liquid crystal panel is a twisted-nematic type liquid crystal panel or an in-plane-switching (IPS) liquid crystal panel.

14. The liquid crystal display as claimed in claim 13, wherein the first substrate further comprises a plurality of pixel electrodes, and the second substrate comprises a plurality of common electrodes opposite to the pixel electrodes.

15. The liquid crystal display as claimed in claim 14, wherein the first substrate further comprises a plurality of first thin film transistors provided in vicinity of a respective point of intersection of the first scanning lines and the first signal lines and a plurality of second thin film transistors provided in vicinity of a respective point of intersection of the second scanning lines and the second signal lines, the first thin film transistors each comprise a gate electrode connected to the corresponding first scanning line, a source electrode connected to the corresponding first signal line, and a drain electrode connected to a corresponding first pixel electrode, the second thin film transistors each comprise a gate electrode connected to the corresponding second scanning line, a source electrode connected to the corresponding second signal line, and a drain electrode connected to a corresponding second pixel electrode.

16. The liquid crystal display as claimed in claim 12, wherein the compensation circuit comprises a signal receiving terminal, a retardation circuit, and a register; the register comprising two input terminals and an output terminal; the signal receiving terminal being directly connected to one of the input terminals of the register, and being also connected to the other input terminal of the register via the retardation circuit; the output terminal being connected to the signal line driving circuit; the register comprising a query chart which generates signals which represent compensation gradation by comparing the first frame image data to a second frame image data next to the first frame image data.

* * * * *